United States Patent [19]

Maroszek

[11] Patent Number: 4,661,671

[45] Date of Patent: Apr. 28, 1987

[54] PACKAGE ASSEMBLY WITH HEATER PANEL AND METHOD FOR STORING AND MICROWAVE HEATING OF FOOD UTILIZING SAME

[75] Inventor: Raymond V. Maroszek, Neenah, Wis.

[73] Assignee: James River Corporation, Norwalk, Conn.

[21] Appl. No.: 817,241

[22] Filed: Jan. 8, 1986

[51] Int. Cl.[4] ..... H05B 6/64

[52] U.S. Cl. ..... 219/10.55 E; 219/10.55 F; 219/10.55 M; 426/107; 426/243; 99/DIG. 14

[58] Field of Search ..... 219/10.55 E, 10.55 F, 219/10.55 M; 426/107, 109, 110, 113, 241, 234, 243; 99/DIG. 14, 451; 206/45.12, 45.2, 45.21, 622, 605

[56] References Cited

U.S. PATENT DOCUMENTS

| | | | |
|---|---|---|---|
| 2,993,633 | 7/1961 | Keller | 206/45.21 X |
| 3,254,793 | 6/1966 | Palmer . | |
| 3,982,685 | 9/1976 | Shimada | 206/233 X |
| 4,096,948 | 6/1978 | Kuchenbecker | 206/622 |
| 4,190,757 | 2/1980 | Turpin et al. | 219/10.55 E |
| 4,505,391 | 3/1985 | Kuchenbecker | 426/113 X |
| 4,553,010 | 11/1985 | Bohrer et al. | 426/243 X |
| 4,555,605 | 11/1985 | Brown et al. | 219/10.55 E |
| 4,574,174 | 3/1986 | McGonigle | 219/10.55 E X |

*Primary Examiner*—Philip H. Leung

*Attorney, Agent, or Firm*—Sixbey, Friedman & Leedom

[57] ABSTRACT

A food package assembly is disclosed for use in heating food in a microwave oven having a support surface wherein the assembly includes a packaging such as a paperboard carton having a detachable panel arranged to (1) form an opening for removal of the food contained in the carton and (2) to leave strengthening portion, such as corner webs, for strengthening the remaining side walls when the opened carton is inverted for use as a cooking stand for the removed food. A microwave interactive material may be applied to the inner side of the removable panel so that the removed panel may be placed on top of the inverted carton to brown the food during the cooking step.

17 Claims, 3 Drawing Figures

PACKAGE ASSEMBLY WITH HEATER PANEL AND METHOD FOR STORING AND MICROWAVE HEATING OF FOOD UTILIZING SAME

DESCRIPTION

1. Technical Field

This invention relates generally to microwave food packages and more particularly to food packages of the type which include an element that will produce a heating effect when exposed to microwave energy for the purpose of crisping or browning food contained thereon.

2. Background Art

With the increase in usage of microwave ovens in homes and the associated growth in the demand for microwaveable prepared foods, various specialized packages have been developed which are designed to achieve microwave browning of food contained therein so as to compensate for the common complaint of consumers to the effect that food cooked by microwave energy lacks the desired degree of brownness or crispness that foods, such as pizzas or french fries, have when cooked in a conventional oven. However, many such specially developed packages are not adaptable to foods which, during heating, have grease or vapor driven out of them or which become soggy in nature. Specialized packages designed to overcome some of these problems are often costly to produce, and are sometimes required to be oversized, relative to the size of the enclosed food item. Such packages increase the costs of shipping and display.

One example of such specialized packaging is disclosed in U.S. Pat. No. 4,190,757 to Turpin et al. This patent discloses a carton for microwave heating of pizza including an interactive layer which converts microwave energy to heat for browning the pizza crust and a spacer element for elevating the interactive layer above the bottom wall of the carton. Due to the specialized configuration of the carton and the need for an internal spacer, excessive cost and size may result from utilization of this design over more conventional packaging.

Microwave packages utilizing interactive layers are also known which require some form of manipulation prior to use such as illustrated in commonly assigned U.S. Pat. No. 4,553,010 to Bohrer. While this package is ideal for microwave heating of certain types of food, such as popcorn, the disclosed package does not necessarily solve the problems associated with microwave cooking of other types of food such as pizza. Still other types of microwave packaging, such as disclosed in commonly assigned U.S. Pat. No. 4,505,391 to Kuchenbecker, discloses a microwave cookin carton having no interactive layer but including elements which may be manipulated prior to cooking to form support legs capable of positioning the carton above the support surface of the oven.

Outside of the microwave cooking field, it has been very conventional to provide paperboard cartons with removable sections defined by lines of weakening formed from a series of perforations or double cut scores. Such removable section may be formed entirely within one panel of the paperboard carton (such as illustrated in U.S. Pat. No. 3,982,685 to Shimada) or may be formed in adjacent panels (such as illustrated in U.S. Pat. No. 3,254,793 to Palmer). While useful for the purpose disclosed, the carton designs disclosed in these references do not suggest how to form an improved carton for microwave cooking.

3. Disclosure of the Invention

The present invention is an extension of the concepts of the Brown et al U.S. Pat. No. 4,555,605, which is assigned to the assignee of the present application, and as such has an object to provide a novel and improved package assembly and packaged food arrangement for use in association with the heating or cooking of a food item in a microwave oven that expands the versatility and effectiveness thereof.

In particular, it is an object of the present invention to provide a food packaging assembly which serves the dual function of providing a packaging mode for shipment and storage of prepared food and a food heating mode wherein the food is rearranged with respect to at least a portion of the packaging assembly and is disposed upon a microwave interactive layer in heat exchange relationship with respect thereto and with respect to an air filled space beneath the microwave interactive layer.

It is another object of the present invention to provide a novel and improved package assembly and package food arrangement wherein an outer package body can be reconfigured into an inverted tray or heating stand configuration whose side walls are not subject to bowing and deformation under the effects of heat and moisture during heating of food thereon in a microwave oven.

It is yet another object of this invention to provide a novel and improved package assembly wherein the act of opening the carton for removal of the food contained therein will automatically provide an invertable heating stand for positioning the food during microwave cooking and will, simultaneously, provide a microwave interactive layer for browning the food.

It is a specific object in accordance with the present invention, whereby the preceding objects are achieved through the use of a tear-out panel designed to provide, after removal of the tear-out panel, rigidifying structure, particularly at the corners of the remaining tray portion of the outer package body, at what will be the bottom edges of the side walls thereof in the inverted heating position thereof.

The above and other objects and advantages of the present invention are achieved, in accordance with a first preferred embodiment, which includes an outer package body in the form of a carton of microwaveable material of a one-piece construction to the inside of a major wall surface of which (such as the top or bottom panel of the carton) a microwave interactive heater material is affixed. By the provision of perforations, zipper knife cuts or double cut-scores located on the panel to which the heater material is affixed, the carton may be opened not only for removal of the food, but also for forming the body of the carton into a tray that can be inverted so as to form a support for the heater panel and food within a microwave oven. In particular, by providing uncut areas running diagonally at each corner of the carton wall having the heater panel, the uncut areas can serve to tie together the side walls of the carton (which forms riser panels of the tray), thereby strengthening the tray configuration. Furthermore, when the removability of the heater panel is achieved by zipper knives or double cut-scores, flange-like portions are provided running the length of the side walls, which further acts to restrict bowing and deformation of the side walls during the microwave heating process.

BEST MODE FOR CARRYING OUT THE INVENTION

Figure 1:
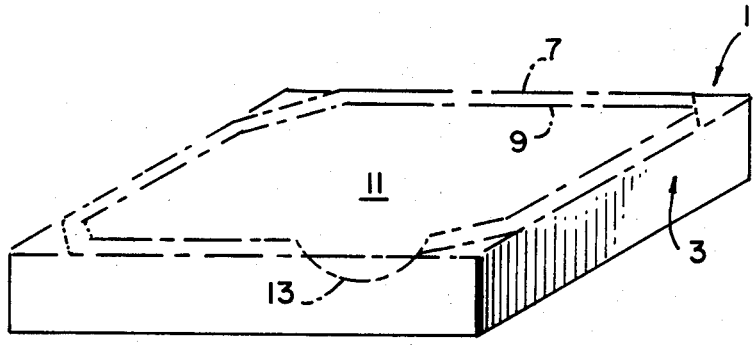
FIG. 1 is a perspective view of a package assembly embodying the present invention in its food storage and shipping mode.

As noted above, the subject invention is a further development of the microwave packaging concepts disclosed in commonly assigned U.S. patent application Ser. No. 738,490 filed June 21, 1985 U.S. Pat. No. 4,612,431 which is a divisional of U.S. patent application Ser. No. 637,057 filed Aug. 2, 1984, now U.S. Pat. No. 4,555,605 to Brown et al.

In U. S. Pat. No. 4,555,605 to Brown et al, a package assembly is disclosed that enables use of a simple package body of the type utilized in packaging food products that are to be cooked or heated by microwave means. In particular, this patent discloses a food packaging assembly, for use in a microwave oven having a support surface, that is comprised of an outer package body which is initially in a packaging mode whereby food is retained within an enclosed food storage space for shipment and storage. The disclosed packaging assembly may be subsequently converted into a cooking mode wherein the food is rearranged relative to at least one of the package assembly components so as to be disposed at a predetermined distance above the microwave oven support surface in heat transfer relationship with respect to a microwave interactive layer. An enclosed air filled space is also created beneath the microwave interactive layer by at least one of the package components, so that, during cooking, the microwave interactive layer will produce the desired degree of crispness of the food product and the air-filled space will promote even cooking of the food.

In one form of arrangement as disclosed relative to the FIG. 4 embodiment of the Brown et al patent, a package assembly is comprised of an outer package body that defines a receiving space, and a disposable inner tray upon which a predetermined quantity of food may be situated during cooking. The packaged body, itself, is of a conventional carton construction of the zip-strip opening type by which opening of the carton results in the package body being divided into two halves that may either be totally separated at all four side walls or separated at only three of the side walls so as to enable the upper and lower halves to remain interconnected by the fourth wall that serves as a hinge. When the FIG. 4 embodiment is used, one half of the outer package body is placed on the floor of the microwave oven with its open end directed downwardly and the other half is placed on top of the first half with its open end directed upwardly. The upwardly directed half has a microwave interactive heating layer joined to what had been the underside of its major panel, which now faces upwardly. The quantity of food is placed within the upwardly directed package half in heat exchange relationship with the microwave interactive layer, while an enclosed air space is formed by the downwardly directed package half in conjunction with the oven floor upon which it is supported. When the oven is turned on, the food is heated by the direct action of the microwave energy, by the crisping effect of the microwave interactive layer that becomes hot under action of the microwave energy, and by the build-up of heat within the enclosed air space that serves to ensure uniform heating.

This patent also discloses other modes whereby the outer package body is reclosed, after removal of the food and an inner food receiving tray, the food and tray being supported upon the reclosed box, in its cooking mode, as well as the top wall of the box which is provided with a tear-out detachable panel which is removable so as to create a tray receiving aperture, whereby the tray and box, together, form the air-filled enclosed space.

While the package assembly in accordance with the Brown et al U.S. Pat. No. 4,555,605 represents a significant improvement in packaging for microwaveable prepared food and is effective in the carrying-out of the novel method for microwave heating of foods disclosed therein, in some instances it has been found that the effects of moisture and heat produced during the microwave heating of foods therewith can result in some bowing and distortion of the side walls. Such deformation of the side walls forming the perimeter of the enclosed air space and the support for the food carried on the interactive layer thereover, in turn, can result in the free edges of the sidewalls ceasing to seat against the support wall of the microwave oven along their entire length as well as deformation of the major panel carrying the interactive layer and food. A failure of the sidewalls to seat on the support wall of the microwave oven can cause some air to flow through the enclosed space thereby detracting, somewhat, from the extent to which heat is built up within the enclosed air space and the even cooking effect promoted thereby while deformation of the major panel can cause an uneven browning and crisping effect to occur.

Figure 2:
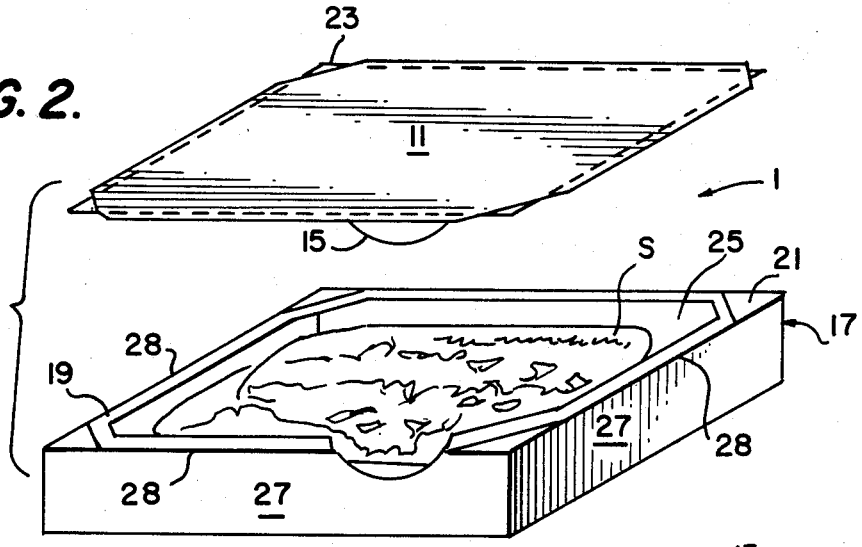
FIG. 2 is a partially exploded perspective view of the package assembly of FIG. 1.

In FIG. 1, the shipping and storage mode of a package assembly designed in accordance with this invention, generally designated by the reference numeral 1, is shown that is comprised of the components most easily discernible with reference to FIG. 2. More particularly, the package assembly is comprised of an outer package body that is in the form of a paperboard carton 3. The carton 3 has an internal receiving space within which a predetermined quantity of food 5, such as a pizza, is disposed for shipping and storage. Carton 3 can be erected from a paperboard blank using conventional packaging techniques so as to be of a one-piece construction that has locked or sealed end panels.

By providing perforations, zipper knife cuts or double cut scores on the top panel along score lines 7, 9, a tear-open panel 11 is provided as a means for opening the carton 3 for removal of the food 5. In this regard, it is noted that the paperboard blank of which the carton 3 is formed is of a multiple layer construction and the outer score line 7 of FIG. 1 is provided in the exterior layer of the blank while the cut score line 9 is provided concentrically within the cut score 7 (except at a localized area 13 where the score lines are aligned so as to provide a pull-out tab 15 that may be used to facilitate rupturing of a connection between the panel 11 and the remaining portion of the carton body 17). As a result, the panel 11 is formed of a larger area of the outer layer than of the inner layer, while the remaining body portion 17 is provided with a ledge 19 that is comprised of only the inner layer of the carton blank material. The purpose of the ledge 19 and uncut corner areas 21 (formed of the full thickness of the carton blank material) will be described in greater detail in connection with a description of FIG. 3.

A layer of microwave interactive heater material 23 is affixed to the inside of the top panel 11 of the carton 3, such as by gluing a sheet of heater material thereto. In this regard, it is noted that microwave interactive heater materials which will convert microwave energy to heat and are suitable for use in browning and crisping of food are known and any such known material may be used for microwave interactive heater material 23 in accordance with the present invention. A particularly suitable material is metallized polyester film laminated to paper as disclosed in U.S. Pat. No. 4,555,605. Furthermore, it is noted that, while the heater material may be confined within the periphery of pull-out panel 11, it need not have diagonally cut-off corners as is the case shown for panel 11. In the case where the heater material will have the illustrated projecting corner portions, these portions of heater material 23 would be left unsecured relative to carton body 3 so as not to interfere with or be torn by the pulling-out of panel 11.

Figure 3:
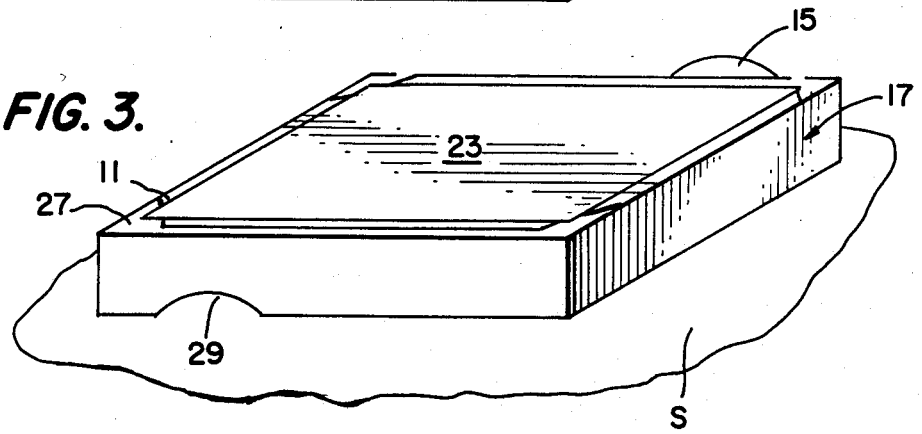
FIG. 3 is a perspective view showing the reconfiguring of the package components into the food heating mode, prior to situating of the food thereon.

Conversion of the assembly 1 from the shipping and storage package condition of FIG. 1 to the heating configuration of FIG. 3, as well as the use thereof for heating prepackaged foods, will now be described. Firstly, the pull-out tab 15 is grasped by the user and pulled in a manner causing a rupturing of the score lines 7, 9, thereby opening the carton 3 forming the outer package body. At this time, the food is removed from the interior receiving space 25. Removal of the panel 11 results in the remaining bottom portion 17 of the carton 13 taking on a tray-like configuration having riser walls 27 (formed of the sidewalls of carton 3) that are tied together at each corner by the uncut corner areas 21. These uncut corner areas 21 and the remaining ledges 19 strengthen the riser walls 27 due to their acting to minimize bowing or other distortions of the riser walls 27 at their adjacent edges 28.

Thus, the body portion 17 can be inverted and placed on top of a support surface of a microwave oven so as to form a heating pedestal or stand. As shown in FIG. 3, once the package body 17 is placed into its pedestal configuration upon support surface S of a microwave oven, in accordance with the present invention, the panel 11 can be situated on the top surface 27 of the heating pedestal, formed by the inverted tray-like remaining body portion 17 of carton 3, in an upside down orientation wherein the heater material 23 faces upwardly. At this time, the food (after removal of any overwrapping bag or the like) is disposed upon the heater material 23 and the microwave oven turned on for the appropriate time and power level.

Because of the provision of the uncut areas 21 and ledges 19, the pedestal formed by the inverted traylike body portion 17 will adequately support the weight of the food object 5 and despite the effects of heat and moisture, riser walls 27 should not significantly bow or deform and should remain seated upon the surface S along substantially the full periphery thereof, except for the area defined by score line 13 which will be an arcuate opening resulting from removal of the pull-out tab 15.

Furthermore, due to the fact that the bottom periphery of the pedestal defined by edges 28 of the riser walls 27 will substantially remain seated against the surface S throughout the cooking process and only a relatively small opening 29 is formed in only one riser wall 17, a substantially enclosed, static air-filled space will be created underneath the panel 11. Because the air in this space is relatively static (i.e., there will be no significant flow of air through the air space) during the heating process, the air within the air space will become heated and act to promote an even cooking of the food supported on the heater material 23 (which is also being heated by the direct action of the microwave energy) in addition to the browning and crisping effect of the heater material 23 which has become hot due to conversion of microwave energy impinging it into heat.

From the foregoing, it should be appreciated that the described embodiment of the present invention provides a simple to use and economical to produce package assembly for shipping, storing and heating of microwaveable prepared foods and will be adaptable to various modifications in construction and usage similar to that obtainable via the FIG. 4 embodiment of the above-mentioned U.S. Pat. No. 4,555,605 and others that will be apparent to those of ordinary skill in the art.

INDUSTRIAL APPLICABILITY

This invention has particular utility in the packaging of food for distribution and sale in refrigerated and frozen display cases and especially in association with the packaging, shipping, vending and microwave heating of a variety of foods that are subject to non-uniform heating by microwave energy and/or require browning or crisping.

I claim:

1. A food package assembly for use in heating a predetermined quantity of food in a microwave oven having a support surface, comprising:

(a) heating means for converting microwave energy into heat, said heating means including a microwave interactive layer; and (b) packaging means combining together said heating means and the predetermined quantity of food in a package assembly constructed in a manner enabling it to be disposed in a first configuration for shipping and storage and a second configuration for heating, said package assembly in said first configuration having the quantity of food disposed within said packaging means, said heating means being attached to a detachable panel portion of a wall of a carton forming said packaging means, and said package assembly in said second configuration having said panel removed and repositioned in association with a remaining body portion of said carton and having the quantity of food removed from within said carton via an opening formed by removal of said panel portion and positionally rearranged relative to said packaging means so as to be supported in heat transfer relation with respect to said microwave interactive layer above a static air-filled space that is formed by said remaining body portion of said carton for promoting even heating of the food when said portion of the packaging means is situated upon a support surface of a microwave oven.

2. A food package assembly according to claim 1, wherein said detachable panel portion is removably secured to said remaining body portion of said carton by rupture means in the form of one of perforations, zipper knife cuts and double cut-scores.

3. A food package assembly according to claim 2, wherein said detachable panel portion is shaped in a manner that, upon detachment thereof, said remaining body portion is of a tray-like shape having a support wall peripherally connected to a plurality of riser walls.

4. A food package assembly according to claim 3, wherein said microwave interactive layer covers a side of said panel portion that is inwardly directed in said first configuration and is upwardly directed in said second configuration, wherein said panel is disposed upon said support wall of the remaining body portion which has been inverted to form said static air-filled space.

5. A food package assembly according to claim 3, wherein the microwave interactive layer is not coextensive in area with said panel portion, parts of said microwave interactive layer extending outside of the perimeter of said panel portion and being unsecured relative to said carton so as not to interfere with removal of said panel portion and to avoid being damaged thereby.

6. A food package assembly according to claim 5, wherein the unsecured parts of the microwave interactive layer are located at said corner areas.

7. A food package assembly according to claim 3, wherein said rupture means is constructed and arranged to leave corner areas tying adjoining riser walls together for minimized deformation of the riser walls during heating of the food.

8. A food package assembly according to claim 7, wherein the microwave interactive layer is not coextensive in area with said panel portion, parts of said microwave interactive layer extending outside of the perimeter of said panel portion and being unsecured relative to said carton so as not to interfere with removal of said panel portion and to avoid being damaged thereby.

9. A food package assembly according to claim 7, wherein said carton is of a multi-layer paperboard construction and said rupture means encompasses a greater area of an outer layer of the carton than of an inner layer thereof so as to form a peripheral ledge upon detachment thereof for minimizing bowing of said sidewalls during heating of said food.

10. A food package assembly according to claim 9, wherein said microwave interactive layer covers a side of said panel portion that is inwardly directed in said first configuration and is upwardly directed in said second configuration, wherein said panel is disposed upon said support wall of the remaining body portion which has been inverted to form said static air-filled space.

11. A food package assembly according to claim 9, wherein the microwave interactive layer is not coextensive in area with said panel portion, parts of said microwave interactive layer extending outside of the perimeter of said panel portion and being unsecured relative to said carton so as not to interfere with removal of said panel portion and to avoid being damaged thereby.

12. A food package assembly according to claim 11, wherein the unsecured parts of the microwave interactive layer are located at said corner areas.

13. A method of heating packaged food in a microwave oven comprising the steps of:

(a) providing a package assembly comprised of a carton type package body having a wall with a detachable panel portion to which a microwave interactive heating layer is attached and within which a quantity of food is disposed;

(b) opening of the package body by detachment of said panel portion from a remaining tray-like portion of the package body;

(c) removing the food from the package body through the opening formed by removal of said panel portion;

(d) rearranging the tray-like portion to form a static air-filled space upon a support surface of a microwave oven;

(e) arranging the quantity of food so as to be supported in heat transfer relationship to the microwave interactive layer over said static air-filled space; and (f) heating the quantity of food.

14. A method according to claim 13, wherein said rearranging step is performed by inverting said tray-like portion of the package body.

15. A method according to claim 14, wherein said panel portion is disposed upon a support wall of the tray-like portion between said rearranging and arranging steps.

16. A method according to claim 14, wherein said opening step is performed in a manner leaving strengthening means on a wall surface from which said panel portion was detached for minimizing distortion of sidewalls of said tray-like portion of the package body during heating of the quantity of food supported thereon.

17. A method according to claim 16, wherein said opening step is performed by the use of rupture means in the form of one of perforations, zipper knives and double cut-scores which leave corner portions, tying together adjoining riser walls of the tray-like portion of the package body, of which said strengthening means is comprised.

* * * * *